US011564462B2

(12) United States Patent
Tan

(10) Patent No.: US 11,564,462 B2
(45) Date of Patent: Jan. 31, 2023

(54) WEARABLE APPARATUS AND BAND THEREOF

(71) Applicant: GUANGDONG OPPO MOBILE TELECOMMUNICATIONS CORP., LTD., Guangdong (CN)

(72) Inventor: Kwang Beng Tan, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 62 days.

(21) Appl. No.: 17/064,914

(22) Filed: Oct. 7, 2020

(65) Prior Publication Data

US 2021/0145135 A1 May 20, 2021

(30) Foreign Application Priority Data

Nov. 20, 2019 (CN) ..... 201922021773.9

(51) Int. Cl.
*A44C 5/20* (2006.01)
*A41D 20/00* (2006.01)
*A44C 5/00* (2006.01)

(52) U.S. Cl.
CPC ..... *A44C 5/2071* (2013.01); *A41D 20/00* (2013.01); *A44C 5/0061* (2013.01); *A44D 2203/00* (2013.01)

(58) Field of Classification Search
CPC ..... A44C 5/2071; A44C 5/2019; A44C 5/20; A44C 5/18; A44C 5/14; A44D 2203/00; G04B 37/1486
See application file for complete search history.

(56) References Cited

U.S. PATENT DOCUMENTS 9,735,823 B1 8/2017 VanDuyn et al.
2013/0326790 A1* 12/2013 Cauwels ..... A61B 5/02233 2/170

(Continued)

FOREIGN PATENT DOCUMENTS

CN 204861557 U 12/2015
CN 207152080 U 3/2018

(Continued)

OTHER PUBLICATIONS

Extended European Search Report for EP Application 20828935.5 dated Oct. 6, 2021. (7 pages).

(Continued)

*Primary Examiner* — Jack W Lavinder
(74) *Attorney, Agent, or Firm* — Young Basile Hanlon & MacFarlane, P.C.

(57) ABSTRACT

A band may include a first strap and a second strap. The first strap may include a first strap body, a first connection portion and a first mating portion. The first strap body may define a connection hole between the first connection portion and the first mating portion. The second strap may include a second strap body, a second connection portion, a second mating portion and a buckle. The second mating portion may be arranged between the second connection portion and the buckle. The buckle is configured to be inserted into the connection hole to connect the first strap body and the second strap body. The second mating portion may be configured to be attracted to and coupled with the first mating portion.

1 Claim, 12 Drawing Sheets

(56) References Cited

U.S. PATENT DOCUMENTS

| | | | | |
|---|---|---|---|---|
| 2016/0007697 | A1 | 1/2016 | de Jong | |
| 2018/0092438 | A1 | 4/2018 | Vandenbussche | |
| 2018/0289116 | A1* | 10/2018 | McCray ..... | A44C 5/0084 |

FOREIGN PATENT DOCUMENTS

| | | | |
|---|---|---|---|
| CN | 105361367 | B | 4/2018 |
| CN | 207506047 | U | 6/2018 |
| CN | 207721326 | U | 8/2018 |
| CN | 207836935 | U | 9/2018 |
| CN | 208259210 | U | 12/2018 |
| CN | 211268914 | U | 8/2020 |

OTHER PUBLICATIONS

Ndian Examination Report for IN Application 202014050493 dated Jun. 3, 2021. (5 pages).

International Search Report for International Application PCT/CN2020/130534 dated Feb. 20, 2021. (9 pages).

* cited by examiner

WEARABLE APPARATUS AND BAND THEREOF

CROSS-REFERENCE TO RELATED APPLICATION(S)

The present application claims foreign priority to Chinese Patent Application No. 201922021773.9, filed on Nov. 20, 2019, the entire contents of which are hereby incorporated by reference in their entireties.

TECHNICAL FIELD

The present disclosure relates to a wearable apparatus.

BACKGROUND

A band of a wearable apparatus such as a smart watch may be configured to enable a user to wear the wearable apparatus onto the user's wrist. The band may generally include a strap body, a buckle structure and a strap hoop. The strap body could pass through the buckle structure and engage with the buckle structure to adjust a dimension of a space enclosed by the band. The strap hoop could move along the strap body to fasten a free end of the strap body.

SUMMARY

According to one aspect of the present disclosure, a band is provided. The band may be configured to wear an electronic apparatus to a body of a user. The band may include a first strap and a second strap. The first strap may include a first strap body, a first connection portion and a first mating portion. The first connection portion may be arranged on an end of the first strap body. The first mating portion may be arranged on another end of the first strap body. The first strap body may define a connection hole between the first connection portion and the first mating portion. The first connection portion may be configured to connect with the electronic apparatus. The second strap may include a second strap body, a second connection portion, a second mating portion and a buckle. The second connection portion may be arranged on an end of the second strap body. The buckle may be arranged on another end of the second strap body. The second mating portion may be arranged between the second connection portion and the buckle. The second connection portion may be configured to connect with the electronic apparatus. The buckle may be configured to be inserted into the connection hole to connect the first strap body and the second strap body. The second mating portion is configured to be attracted to and coupled with the first mating portion.

According to second aspect of the present disclosure, a band is provided. The band may be configured to wear an electronic apparatus to a body of a user. The band may include a first strap and a second strap. The first strap may include a first strap body, a first connector and a magnet. The first connector may be arranged on an end of the first strap body. The magnet may be arranged on another end of the first strap body. The first strap body may define a plurality of through holes between the first connector and the magnet. The first connector may be configured to connect with the electronic apparatus. The second strap may include a second strap body, a second connector, a plurality of magnetic metal pieces and an anchor. The second connector may be arranged on an end of the second strap body. The anchor may be arranged on another end of the second strap body. The plurality of magnetic metal pieces may be arranged between the second connector and the anchor. The second connector may be configured to connect with the electronic apparatus. The anchor may be configured to pass through one of the plurality of through holes to connect the first strap body and the second strap body. The plurality of magnetic metal pieces may be configured to be attracted to the magnet by magnetic force.

According to a third aspect of the present disclosure, a wearable apparatus is provided. The wearable apparatus may include an electronic apparatus and the above-mentioned band.

BRIEF DESCRIPTION OF DRAWINGS

In order to more clearly illustrate technical solutions of the present disclosure or the prior art, drawings required in the description of the embodiments or the prior art will be briefly introduced below. Obviously, the drawings in the following description are only some embodiments of the present disclosure. For those of ordinary skills in the art, other drawings could be obtained based on these drawings without creative efforts.

DETAILED DESCRIPTION

Figure 1:
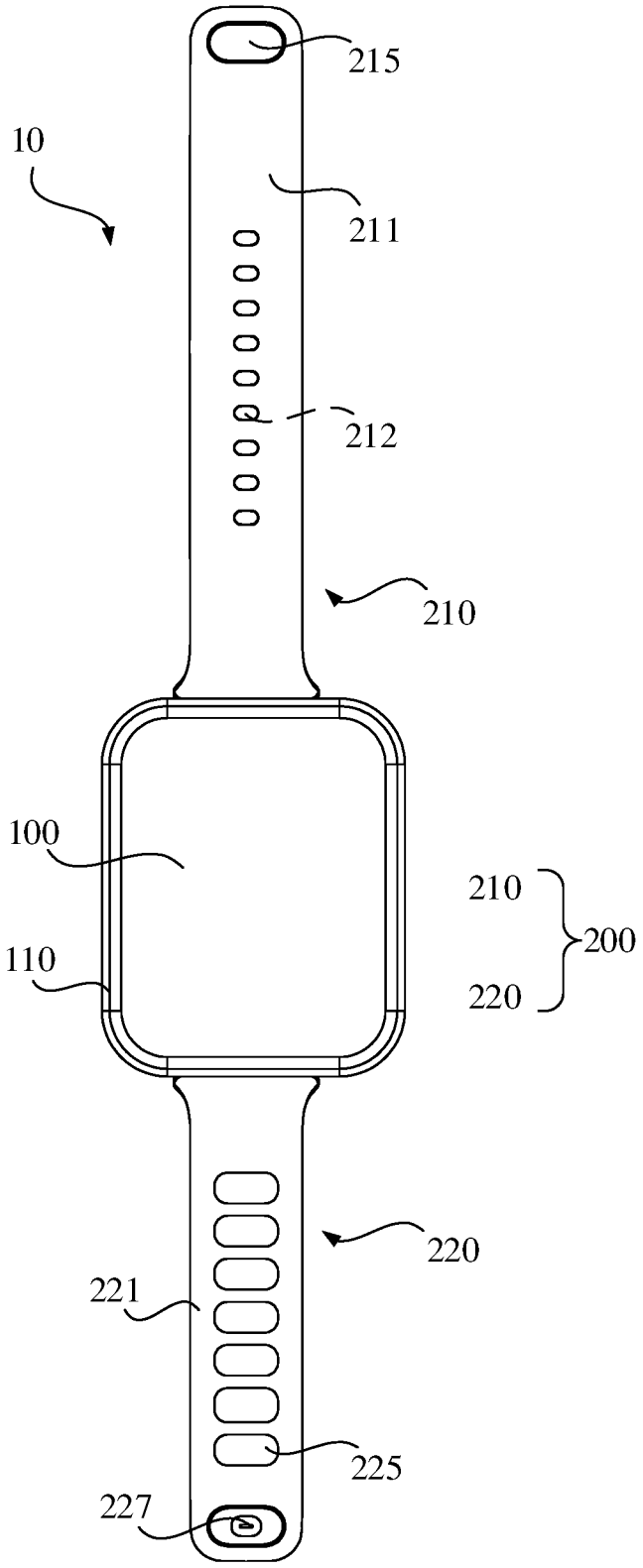
FIG. 1 is a front view of a wearable apparatus of the present disclosure.

For better understanding of the present disclosure, the present disclosure will be described in a more comprehensive manner referring to relevant drawings. However, the present disclosure may be embodied in many different forms, which are not limited to the embodiments illustrated in the present disclosure. On the contrary, the purpose of providing these embodiments is to make the understanding of the present disclosure more thorough and comprehensive.

In some embodiments, a band configured to wear an electronic apparatus to a body of a user is provided. The band may include a first strap and a second strap. The first strap may include a first strap body, a first connection portion and a first mating portion. The first connection portion may be arranged on an end of the first strap body. The first mating portion may be arranged on another end of the first strap body. The first strap body may define a connection hole between the first connection portion and the first mating portion. The first connection portion may be configured to connect with the electronic apparatus. The second strap may include a second strap body, a second connection portion, a second mating portion and a buckle. The second connection portion may be arranged on an end of the second strap body. The buckle may be arranged on another end of the second strap body. The second mating portion may be arranged between the second connection portion and the buckle. The second connection portion may be configured to connect with the electronic apparatus. The buckle may be configured to be inserted into the connection hole to connect the first strap body and the second strap body. The second mating portion may be configured to be attracted to and coupled with the first mating portion.

In some embodiments, one of the first mating portion and the second mating portion may include a magnet. The other one of the first mating portion and the second mating portion may include a magnet or a magnetic metal piece.

In some embodiments, the first strap body may include a first side surface and a second side surface opposite to each other. The connection hole may penetrate the first side surface and the second side surface. When the electronic apparatus is worn to the body of the user, the first side surface may fit the body of the user. The second strap body may include a third side surface and a fourth side surface opposite to each other. The buckle may protrude from the fourth side surface. When the electronic apparatus is worn to the body of the user, the third side surface may fit the body of the user. The fourth side surface may be configured to abut against the first mating portion.

In some embodiments, the first mating portion may include a magnet. The second mating portion may include a magnetic metal piece. The magnetic metal piece may be hidden in the second strap body.

In some embodiments, a number of the magnetic metal pieces may be more than two. The more than two magnetic metal pieces may be arranged on the second strap body at intervals along a direction extending from the second connection portion to the buckle.

In some embodiments, the first mating portion may include a magnet. The second mating portion may include a magnetic metal piece. The magnetic metal piece may be exposed to the fourth side surface.

In some embodiments, a shape of an exposed surface of the magnetic metal piece may be a rectangle with arc corners or a racetrack shape.

In some embodiments, the first mating portion may include a first magnet. The second mating portion may include a second magnet. The second magnet may be hidden in the second strap body.

In some embodiments, a number of the second magnet may be more than two. The more than two second magnet may be arranged in the second strap body at intervals along a direction extending from the second connection portion to the buckle.

In some embodiments, along a direction extending from the first mating portion to the first connection portion, a width of an end of the first strap body away from the first mating portion may gradually increase.

In some embodiments, when the first strap body may be in an unbending state, an angle between a length extension direction of the first connection portion and a length extension direction of the first strap body may be an acute angle.

In some embodiments, a first planar surface may be provided on an end of the first connection portion away from the first strap body. The first planar surface may be obliquely arranged relative to a length extension direction of the first connection portion. A first groove may be defined between the first strap body and the first planar surface, and configured to receive a locking structure of the electronic apparatus to fix the first strap to the electronic apparatus.

In some embodiments, along a direction extending from the buckle to the second connection portion, a width of an end of the second strap body away from the buckle may gradually increase.

In some embodiments, when the second strap body is in an unbending state, an angle between a length extension direction of the second connection portion and a length extension direction of the second strap body may be an acute angle.

In some embodiments, the first strap body may define a first through hole penetrating the first side surface and the second side surface. The first mating portion may be mounted in the first through hole. The first mating portion may be exposed to at least one of the first side surface and the second side surface.

In some embodiments, the second strap body may define a second through hole penetrating the third side surface and the fourth side surface. The buckle may be mounted in the second through hole. An end of the buckle away from the fourth side surface may be exposed to the third side surface.

In some embodiments, the first side surface defines a first recess region. The connection hole may be arranged in the first recess region.

In some embodiments, the third side surface may define a second recess region. The second mating portion may be arranged in the second recess region. In some embodiments, a band configured to wear an electronic apparatus to a body of a user may be provided. The band may include a first strap and a second strap. The first strap may include a first strap body, a first connector and a magnet. The first connector may be arranged on an end of the first strap body. The magnet may be arranged on another end of the first strap body. The first strap body may define a plurality of through holes between the first connector and the magnet. The first connector may be configured to connect with the electronic apparatus. The second strap may include a second strap body, a second connector, a plurality of magnetic metal pieces and a anchor. The second connector may be arranged on an end of the second strap body. The anchor may be arranged on another end of the second strap body. The plurality of magnetic metal pieces may be arranged between the second connector and the anchor. The second connector may be configured to connect with the electronic apparatus. The anchor may be configured to pass through one of the plurality of through holes to connect the first strap body and the second strap body. The plurality of magnetic metal pieces may be configured to be attracted to the magnet by magnetic force. In some embodiments. a wearable apparatus may be provided. The wearable apparatus may include an electronic apparatus and a band. The band may include a first strap and a second strap. The first strap may include a first strap body, a first connection portion and a first mating portion. The first connection portion may be arranged on an end of the first strap body. The first mating portion may be arranged on another end of the first strap body. The first strap body may define a connection hole between the first connection portion and the first mating portion. The first connection portion may be configured to connect with the electronic apparatus. The second strap may include a second strap body, a second connection portion, a second mating portion and a buckle. The second connection portion may be arranged on an end of the second strap body. The buckle may be arranged on another end of the second strap body. The second mating portion may be arranged between the second connection portion and the buckle. The second connection portion may be configured to connect with the electronic apparatus. The buckle may be configured to be inserted into the connection hole to connect the first strap body and the second strap body. The second mating portion may be configured to be attracted to and coupled with the first mating portion.

Referring to FIG. 1, a wearable apparatus 10 may include an electronic apparatus 100 and a band 200. The electronic apparatus 100 may include a housing 110 and electronic components arranged in the housing 110. The band 200 may be mounted to the housing 110. The band 200 may be configured to enable the electronic apparatus 100 being worn onto a body of a user. The housing 110 may be made of non-metallic materials such as plastic, rubber, silica gel, wood, ceramic or glass etc. The housing 110 may be made of metal materials such as stainless steel, aluminum alloy or magnesium alloy. The housing 110 may be provided with a mounting cavity configured to receive the electronic components of the electronic apparatus 100. In some embodiments, the wearable apparatus 10 may be a smart watch. The mounting cavity 101 may be configured to receive the electronic components such as a battery, a circuit board, a display screen and a biosensor. The circuit board may integrate a processor, a storage unit, a communication module etc. The battery may supply power for the circuit board, the display screen and other electronic components. The display screen may not be necessary. The biosensor may be configured to detect biological data such as a heart rate, a respiration rate, a blood pressure or a body fat rate. In some embodiments, the biosensor may be configured to detect a motion state. As an example, the biosensor may be configured for step counting. In some embodiments, the wearable apparatus 10 may be a sports watch or a conventional watch etc. A common form of the sports watch may be an electronic watch. A common form of the conventional watch may be a mechanical watch. In other embodiments, the wearable apparatus 10 may also be a smart bracelet.

Figure 2:
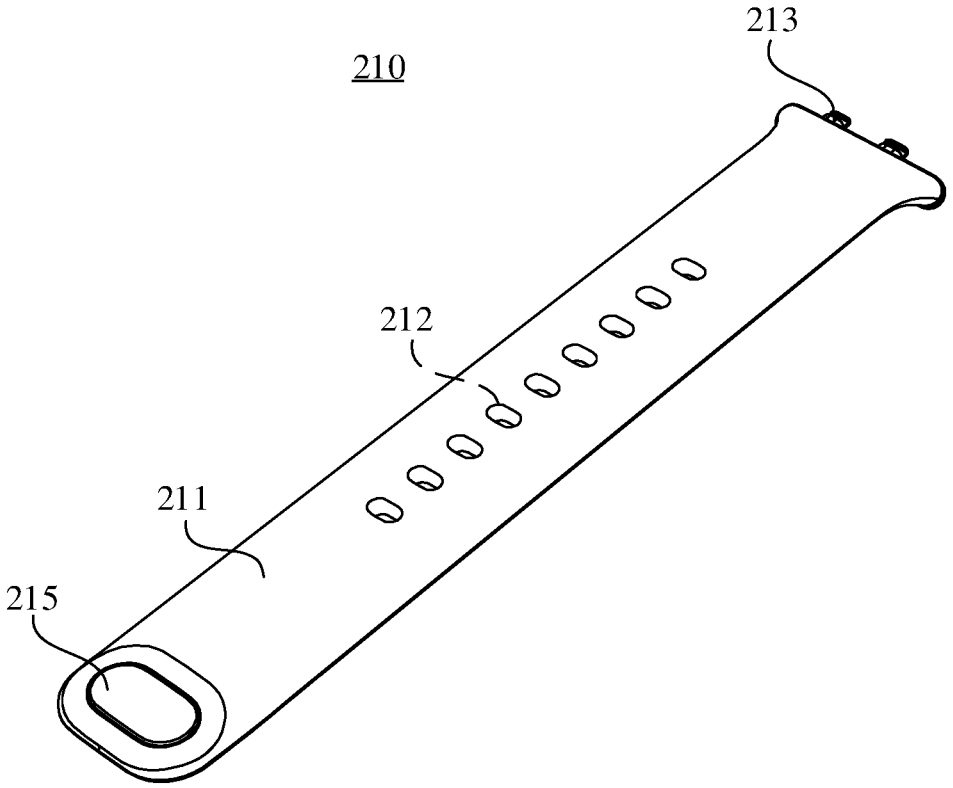
FIG. 2 is a schematic diagram of a first strap of the wearable apparatus in FIG. 1.
Figure 3:
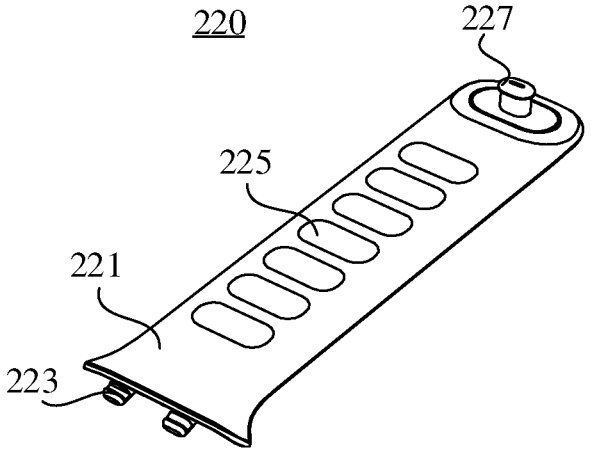
FIG. 3 is a schematic diagram of a second strap of the wearable apparatus in FIG. 1.

In an embodiment illustrated in FIG. 1, the housing 110 may generally be rectangular. Four corners of the rectangle may be chamfered into circular arc transitions, such that the wearable apparatus 10 may have a better appearance characteristic. Each of the two opposite ends of the housing 110 may be provided with a mounting groove to mount the band 200. Referring to FIG. 2 and FIG. 3, the band 200 may include a first strap 210 and a second strap 220. Each of the first strap 210 and the second strap 220 may have a shape of a bar. The two bands 200 may each have an end connecting with the housing 110 of the electronic apparatus 100. Free ends of the two bands 200 may be engaged with each other to form an enclosed space, such that the wearable apparatus 10 may be worn to an arm or a wrist or other sites of a body of the user by the bands 200. In some embodiments, the band 200 may also be able to be easily detached from the housing 110, such that the user may easily replace the bandage 200. For example, the user may purchase multiple styles of bands 200, and choose different styles of bands 200 according to different usage scenarios to meet diverse needs of users. Of course, the easy detachable characteristic of the bands 200 may not be essential.

Figure 4:
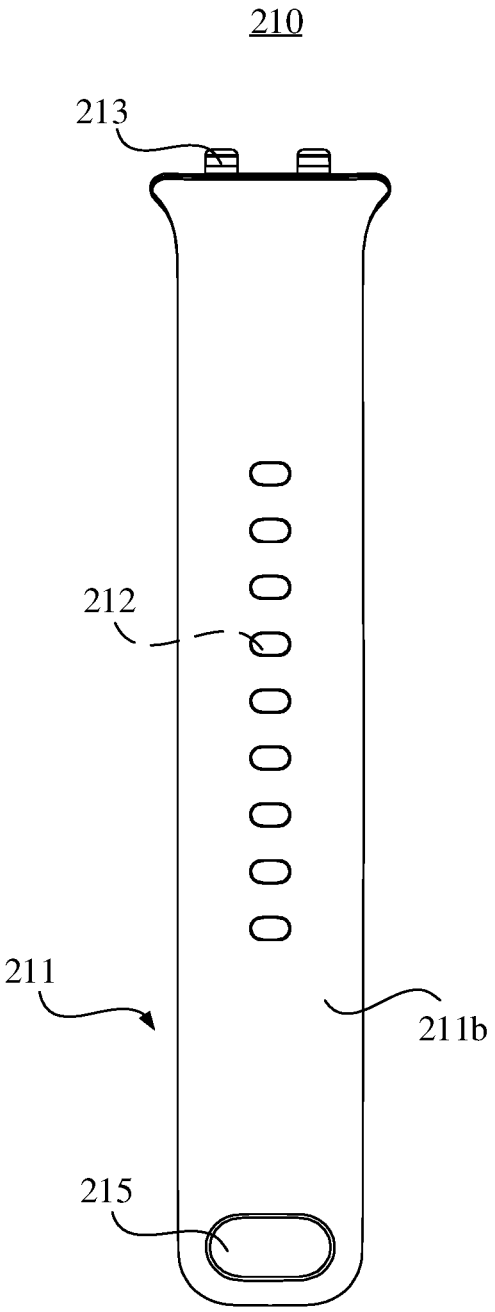
FIG. 4 is a front view of the first strap of the wearable apparatus in FIG. 2.
Figure 5:
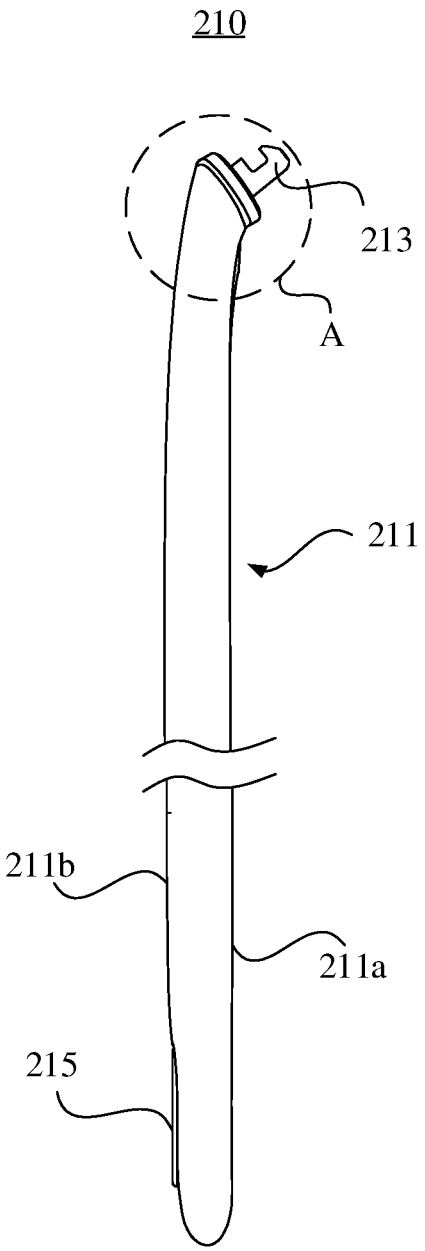
FIG. 5 is a right view of the first strap of the wearable apparatus in FIG. 4.
Figure 6:
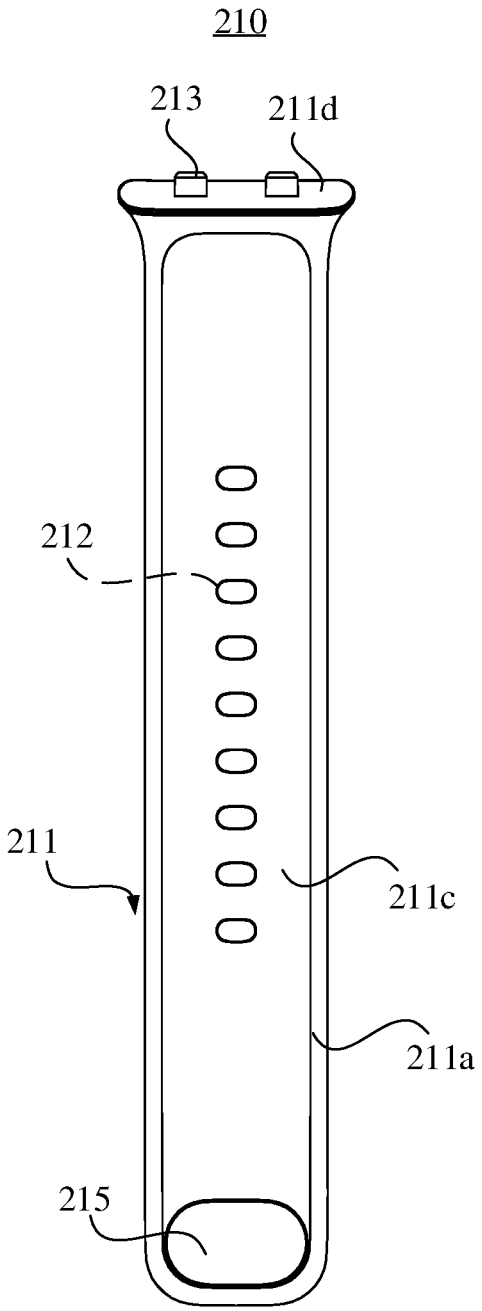
FIG. 6 is a rear view of the first strap of the wearable apparatus in FIG. 4.
Figure 7:
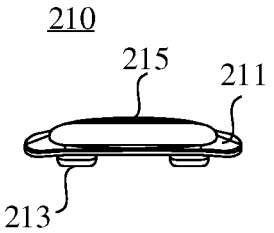
FIG. 7 is a bottom view of the first strap of the wearable apparatus in FIG. 4.
Figure 8:
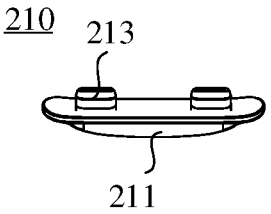
FIG. 8 is a top view of the first strap of the wearable apparatus in FIG. 4.

Referring to FIG. 4, FIG. 5 and FIG. 6, the first strap 210 may include a first strap body 211, a first connection portion 213 (which may also be called as a first connector) and a first mating portion 215. The materials of the first strap body 211 may be plastic, leather, rubber, silica gel, or other high polymer materials. The first strap body 211 may have a certain degree of flexibility, thus the first strap body 210 may better fit the user's body. Further referring to FIG. 7 and FIG. 8, the first connection portion 213 and the first mating portion 215 may be arranged on two ends of the first strap body 211 respectively. That is, the first connection portion 213 is arranged on an end of the first strap body 211, the first mating portion 215 is arranged on another end of the first strap body 211. The first strap body 211 may define a connection hole 212 (which may also be called as a through hole 212). There may be a plurality of connection holes 212 defined in the first strap body 211. Particularly, a number of the plurality of connection holes 212 may be two or more than two. The plurality of connection holes 212 may be arranged at intervals and located between the first connection portion 213 and the first mating portion 215. The first connection portion 213 may be configured to connect with the electronic apparatus 100, to reliably fix the first strap 210 to the electronic apparatus 100. The first mating portion 215 may be arranged on the free end of the first strap body 211.

Figure 9:
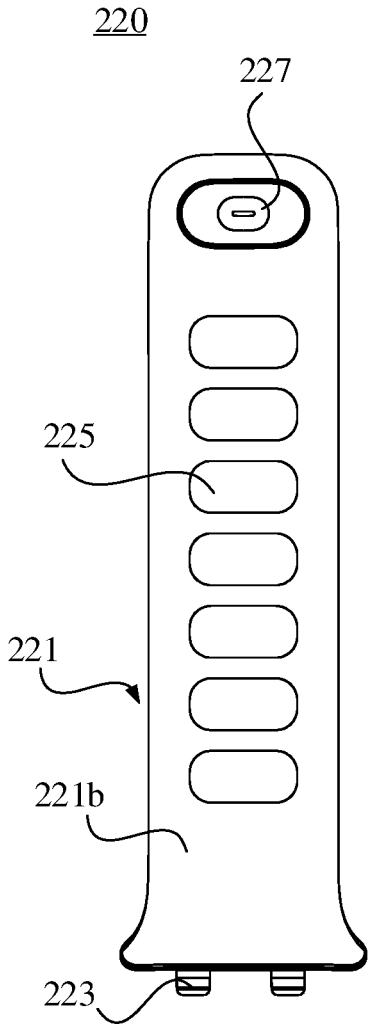
FIG. 9 is a front view of the second strap of the wearable apparatus in FIG. 3.
Figure 10:
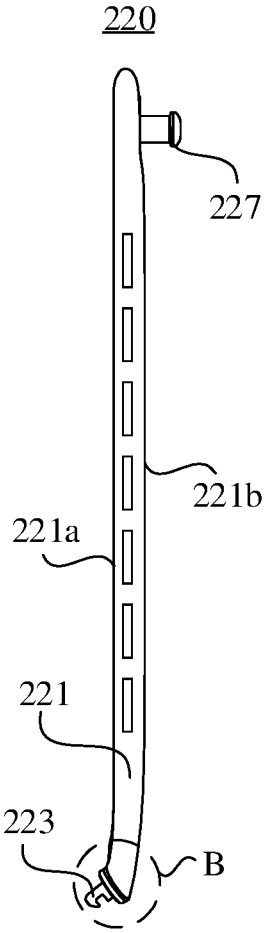
FIG. 10 is a left view of the second strap of the wearable apparatus in FIG. 9.
Figure 11:
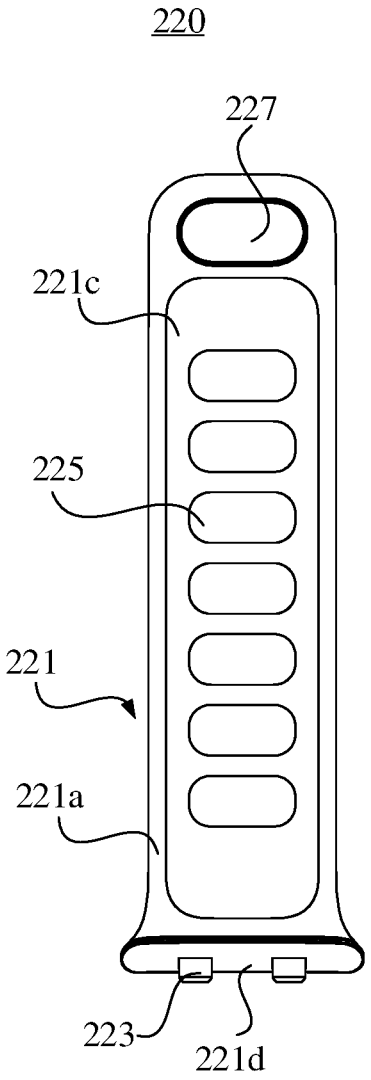
FIG. 11 is a rear view of the second strap of the wearable apparatus in FIG. 9.
Figure 12:
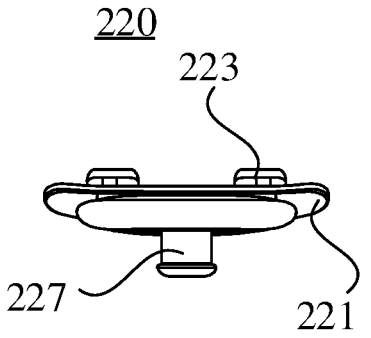
FIG. 12 is a top view of the second strap of the wearable apparatus in FIG. 9.
Figure 13:
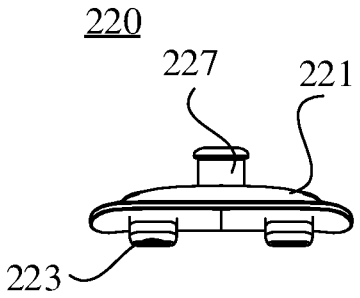
FIG. 13 is a bottom view of the second strap of the wearable apparatus in FIG. 9.
Figure 14:
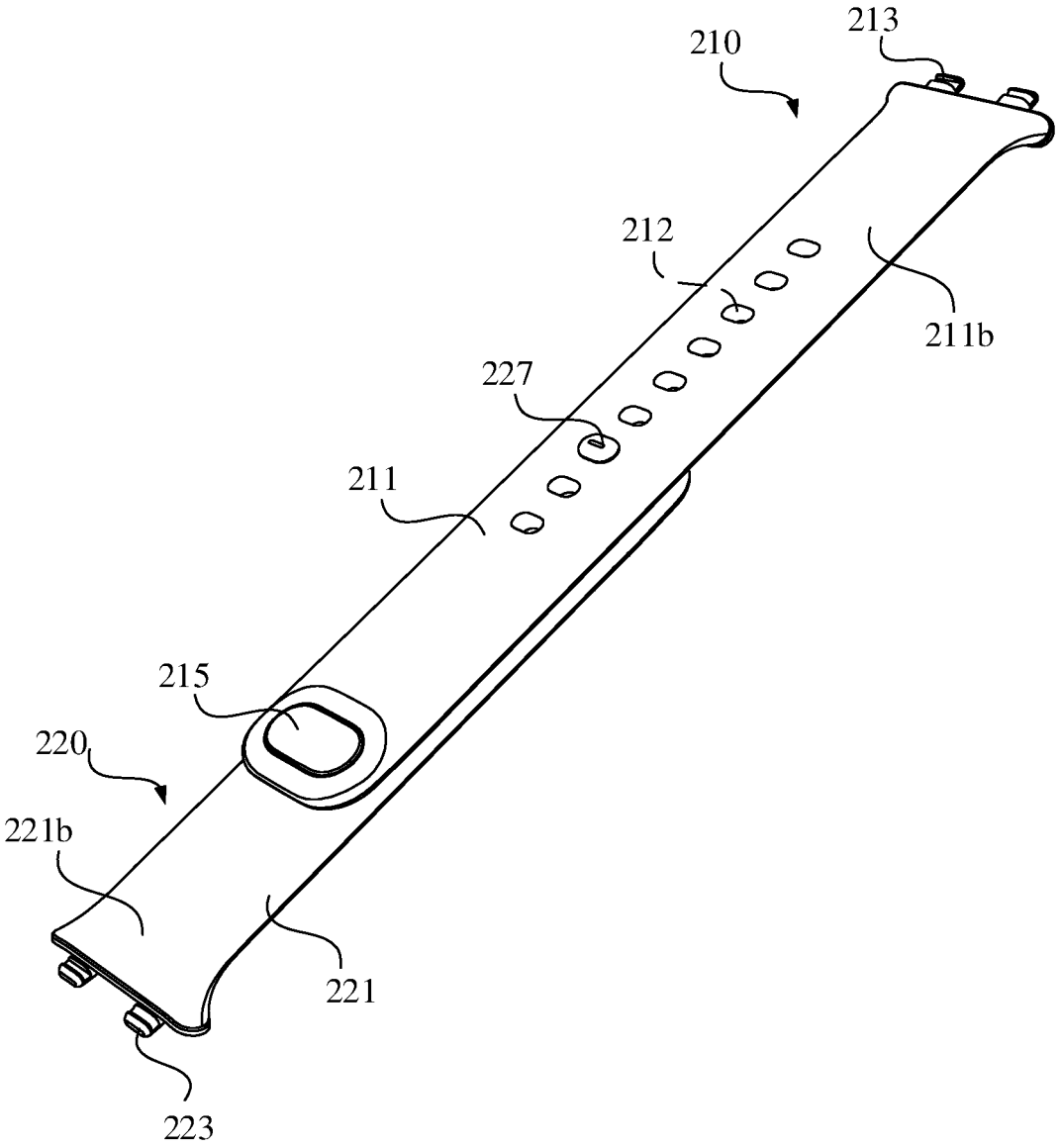
FIG. 14 is a schematic diagram of the first strap and the second strap of the wearable apparatus in FIG. 1 upon an engagement between the first strap and the second strap.

Referring to FIG. 9, FIG. 10 and FIG. 11, the second strap 220 may include a second strap body 221, a second connection portion 223 (which may also be called as the second connector), a second mating portion 225 and a buckle 227 (which may also be called as an anchor). The materials of the second strap body 221 may be plastic, leather, rubber, silica gel, or other high polymer materials. The second strap body 221 may have a certain degree of flexibility, thus the second strap body 220 may better fit the user's body. Referring to FIG. 12 and FIG. 13, the second connection portion 223 and the buckle 227 may be arranged on two ends of the second strap body 221 respectively. That is, the second connection portion 223 is arranged on an end of the second strap body 221, the second mating portion 225 is arranged on another end of the second strap body 221. The second mating portion 225 may be arranged between the second connection portion 223 and the buckle 227. The second connection portion 223 may be configured to connect with the electronic apparatus 100, to reliably fix the second strap 220 to the housing 110 of the electronic apparatus 100. The buckle 227 may protrude from the second strap 220. Also referring to FIG. 14, the buckle 227 may be inserted into the connection hole 212 and form an interference fit or a transition fit with the connection hole 212, such that positions of the first strap body 211 and the second strap body 221 may be relatively fixed, and the first strap 210 and the second strap 220 may form an enclosed space for the wrist or the arm or other sites of the body of the user to pass through. After the buckle 227 of the second strap 220 is inserted into the connection holes 212 of the first strap 210 to form an engagement between the buckle 227 and the first strap 210, the first mating portion 215 on the free end of the first strap 210 may be attracted to and coupled with the second mating portion 225, such that the free end of the first strap 210 may be reliably fixed to the second strap 220, thereby providing the wearable apparatus 10 with a concise appearance characteristic.

In some embodiments of the present disclosure, a shape of the first strap 210 may be similar to a shape of the second strap 220. A length of the first strap 210 may be greater than a length of the second strap 220. When the first strap 210 and the second strap 220 cooperate to form the enclosed space, width of portions of the first strap 210 and the second strap 220 fitting with each other may be identical, thus the wearable apparatus 10 may have a relatively concise appearance characteristic when being worn to the body of the user. Further, the free end of the first strap body 211 and the free end of the second strap body 221 may be respectively chamfered, such that the first strap 210 and the second strap 220 may have better appearance characteristic. Of course, in other embodiments, the length of the first strap 210 may be identical with the length of the second strap 220.

Referring to FIG. 4, FIG. 5 and FIG. 6, the first strap body 211 may include a first side surface 211*a* and a second side surface 211*b* opposite to each other. The first side surface 211*a* may be a planar surface or a curved surface. The second side surface 211*b* may be a planar surface or a curved surface. The connection holes 212 may penetrate the first side surface 211*a* and the second side surface 211*b*. When the electronic apparatus 100 is worn to the user's body, the first side surface 211*a* may fit the body of the user. Referring to FIG. 9, FIG. 10 and FIG. 11, the second strap body 221 may include a third side surface 221*a* and a fourth side surface 221*b* opposite to each other. The third side surface 221*a* may be a planar surface or a curved surface. The fourth side surface 221*b* may be a planar surface or a curved surface. The buckle 227 may protrude from the fourth side surface 221*b*. When the electronic apparatus 100 is worn to the body of the user, the third side surface 221*a* may fit the body of the user, and the first mating portion 215 may fit the fourth side surface 221*b*.

One of the first mating portion 215 and the second mating portion 225 may include a magnet, the other one of the first mating portion 215 and the second mating portion 225 may include a magnet or magnetic metal piece. The magnetic metal piece may be made of iron, cobalt, nickel and alloys thereof, such that the second mating portion 225 and the first mating portion 215 may be attracted to each other by magnetic attractive force, therefore the free end of the first strap 210 may be reliably fixed to a surface of the second strap 220. In particular, in some embodiments, the first mating portion 215 may include a magnet, the second mating portion 225 may include more than two magnetic metal pieces. The magnetic metal pieces may be exposed to the fourth side surface 221*b*. More than two magnetic metal pieces may be arranged on the second strap body 221 at intervals along a direction extending from the second connection portion 223 to the buckle 227. Further, the shape of the exposed surface of the magnetic metal piece may be a rectangle with arc corners or a racetrack shape, such that the second strap 220 may have better appearance characteristic. Specifically, the racetrack shape may refer to a figure composed of two semicircular arcs each connecting with two opposite sides of a same rectangle. For example, in some embodiments, the second mating portion 225 may be a thin sheet structure made of stainless steel. Surface of the second mating portion 225 exposed to the fourth side surface 221*b* may have a shape of a rectangle with arc corners or racetrack. The second mating portion 225 may have a good decorative effect on the second strap 220. Of course, in other embodiments, a shape of the second mating portion 225 exposed to the fourth side surface 221*b* may be a circular, an oval, a rectangle or other shapes. The second mating portion 225 may also be hidden in the second strap body 221.

Further, referring to FIG. 4 and FIG. 6, in some embodiments, the first strap body 211 may be provided with a first through hole penetrating the first side surface 211*a* and the second side surface 211*b*. The first mating portion 215 may be mounted in the first through hole. The first mating portion 215 may be exposed to the first side surface 211*a* and the second side surface 211*b*. The first mating portion 215 may be fixed to the first strap body 211 by an interference fit, a riveting, a bonding or other connection ways. The first mating portion 215 may be made of a magnetic component wrapped by a metal shell or a magnetic component coated with metal film. The first mating portion 215 may be exposed to the first side surface 211*a* and the second side surface 211*b*, so as to decorate the first strap 210 and obtain a more concise appearance characteristic. Of course, in other embodiments, the first mating portion 215 may be made of a magnetized magnetic metal. Further, in other embodiments of the present disclosure, a surface of the first mating portion 215 exposed to the first side surface 211*a* may have a shape of a racetrack, and a surface of the first mating portion 215 exposed to the second side surface 211*b* may have a shape of a racetrack, such that the first mating portion 215 have a better decorative effect, and the first mating portion 215 may obtain a relatively large contact area to improve the stability of attraction. In other embodiments, the exposed surface of the first mating portion 215 may have a shape of a rectangle with arc corners, a rectangle, an oval, a circular etc.

Further, referring to FIG. 9 and FIG. 11, in some embodiments, the second strap body 221 may be provided with a second through hole penetrating the third side surface 221*a* and the fourth side surface 221*b*. The buckle 227 may be mounted in the second through hole. An end of the buckle 227 away from the fourth side surface 221*b* may be exposed to the third side surface 221*a*. The buckle 227 may be fixed to the second strap body 221 by an interference fit, a riveting, a bonding or other connection ways. The buckle 227 may be made of metal or other material plated with a metal film, and the buckle 227 may be exposed to the third side surface 221*a* to decorate the second strap 220 and obtain a more concise appearance characteristic. Further, in some embodiments of the present disclosure, a surface of the buckle 227 exposed to the third side surface 221*a* may have a shape of a racetrack, such that the buckle 227 may have a better decorative effect. In other embodiments, the surface of the buckle 227 exposed to the third side surface 221*a* may have a shape of a rectangle with arc corners, a rectangle, an oval, a circular etc.

In other embodiments, the first mating portion 215 may include a first magnet, the second mating portion 225 may include more than two magnets. The second mating portion 225 may be arranged in the second strap body 221. Along a direction extending from the second connection portion 223 to the buckle 227, more than two second magnets may be arranged in the second strap body 221 at intervals. For the first strap 210 and the second strap 220 with this structure, the first mating portion 215 and the second mating portion 225 may also be attracted to and coupled with each other by a magnetic attraction, such that a free end of the first strap 210 may be reliably fixed on the second strap 220.

Referring to FIG. 6, in some embodiments, the first side surface 211*a* may define a first recess region 211*c*. The connection hole 212 may be located in the first recess region 211*c*. The provision of the first recess region 211*c* may reduce a thickness of the first strap body 211, thereby facilitating a light and thin design of the first strap body 211. Further, referring to FIG. 11, the third side surface 221*a* may be provided with a second recess region 221*c*, the second mating portion 225 may be located in the second recess region 221*c*. The provision of the second recess region 221*c* may reduce a thickness of the second strap body 221, thereby facilitating a light and thin design of the second strap body 221.

Referring to FIG. 4 and FIG. 6, along a direction extending from the first mating portion 215 to the first connection portion 213, a width of an end of the first strap body 211 away from the first mating portion 215 may gradually increase. Further, an end of the first strap body 211 away from the first mating portion 215 may bend toward a side where the first side surface 211*a* is located, and may form a planar first end surface 211*d* at the end of the first strap body 211. The first connection portion 213 may protrude from the first end surface 211*d*. In some embodiments, a width of the housing 110 of the electronic apparatus 100 may be greater or equal to a maximum width of the first strap 210. The first strap 210 with the above structure could form a curved surface that smoothly transitions to the housing 110 at an end of the first strap body 211 away from the first mating portion 215, such that after the first strap 210 is fixedly mounted on the housing 110, the wearable apparatus 10 may have a concise and smooth appearance contour, thereby improving the appearance characteristic of the wearable apparatus 10. After the first strap 210 with the above-mentioned structure is mounted in the housing 110, a larger end of the first strap body 211 may also be configured to shield the mounting groove of the housing 110, thereby improving the waterproof and dustproof performance of the wearable apparatus 10, and compared with a design in which the whole first strap body 211 having a same width, materials may be saved and costs may be cut.

Figure 15:
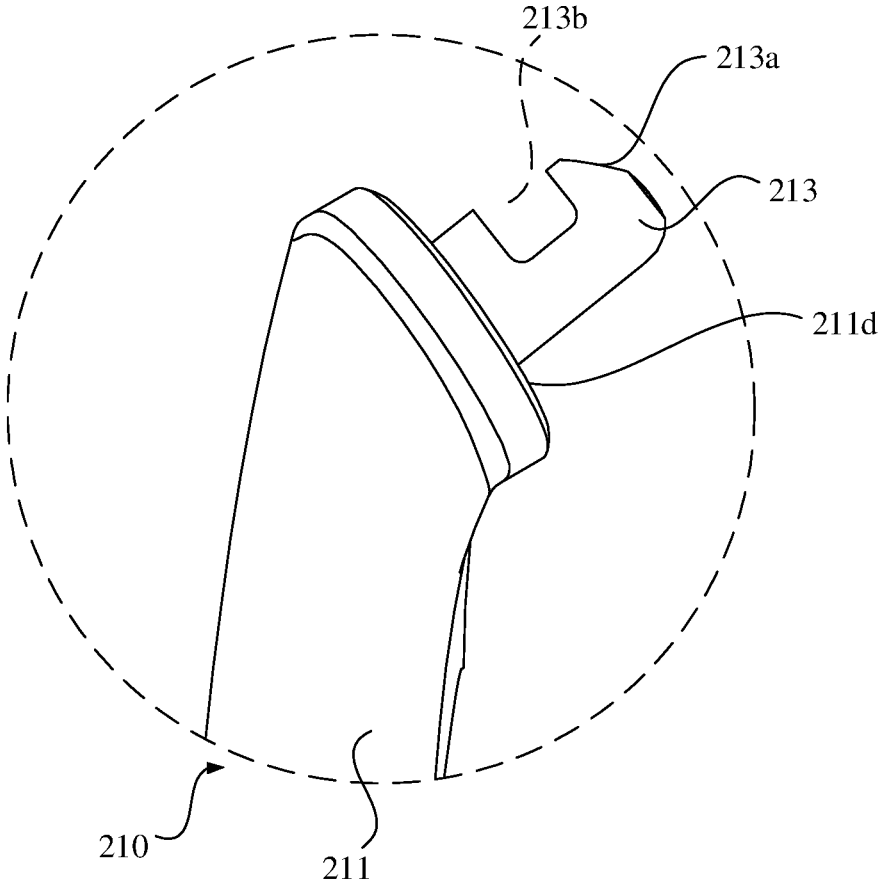
FIG. 15 is an enlarged schematic diagram at portion A of the first strap of the wearable apparatus in FIG. 5.

Further, when the first strap body 211 is in an unbending state, an angle between a length extension direction of the first connection portion 213 and a length extension direction of the first strap body 211 may be an acute angle. For a first strap 210 with this structure, after the first strap 210 is fixedly mounted on the housing 110, the first strap 210 may bend toward a side where the first side surface 211*a* is located, so as to better form an enclosed space, thereby wearing the electronic apparatus 100 to the body. And this kind of structure may avoid a reduction of a fatigue life of the first strap body 211 due to a too large bending of the first strap body 211 during the wearing process. Further, referring to FIG. 15, an end of the first connection portion 212 away from the first strap body 211 may be provided with a first planar surface 213*a*. The first planar surface 213*a* may be obliquely arranged relative to the length extension direction of the first connection portion 213. A first groove 213*b* may be defined between the first strap body 211 and the first planar surface 213*a*. The first groove 213*b* may be configured to mate with the electronic apparatus 100, thereby fixing the first strap 210 to the electronic apparatus 100. In some embodiments, during the process of inserting the first planar surface 213*a* of the first connection portion 213 into the housing 110 of the electronic apparatus 100, the first planar surface 213*a* could drive a locking structure in the housing 110 to move, such that the locking structure could enter the first groove 213*b*, and then be confined in the housing 110 by an end of the first connection portion 213.

Referring to FIG. 9 and FIG. 11, along a direction extending from the buckle 227 to the second connection portion 223, a width of an end of the second strap body 221 away from the buckle 227 may gradually increase. Further, the end of the second strap body 221 away from the buckle 227 may bend toward a side where the third side surface 221*a* is located, and a planar second end surface 221*d* may be formed at the end of the second strap body 221. The second connection portion 223 may protrude from the second end surface 221*d*. In some embodiments, a width of the housing 110 of the electronic apparatus 100 may be greater or equal to a maximum width of the second strap 220. The second strap 220 with the above structure can form a curved surface that smoothly transitions to the housing 110 at the end of the second strap body 221 away from the buckle 227, such that after the second strap 220 is fixedly mounted on the housing 110, the wearable apparatus 10 may have a concise and smooth appearance contour, thereby improving the appearance characteristic of the wearable apparatus 10. After the second strap 220 with the above-mentioned structure is mounted to the housing 110, a larger end of the second strap body 221 may also be configured to shield the mounting groove of the housing 110, thereby improving the waterproof and dustproof performance of the wearable apparatus 10. Compared with a design in which the whole second strap body 221 having a same width, the second strap 220 with the above-mentioned structure may save materials and reduce the cost.

Figure 16:
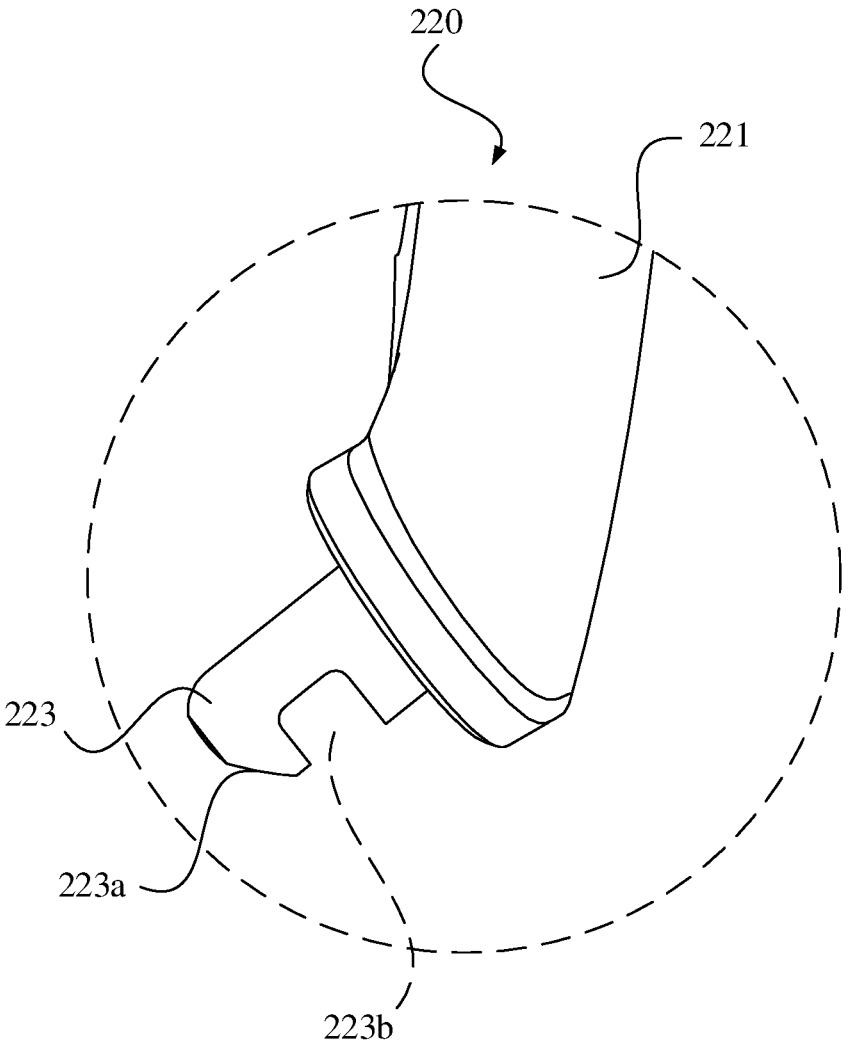
FIG. 16 is an enlarged schematic diagram at portion B of the second strap of the wearable apparatus in FIG. 10.

Further, when the second strap body 221 is in an unbending state, an angle between the length extension direction of the second connection portion 223 and a length extension direction of the second strap body 221 may be an acute angle. For a second strap 220 with this structure, after the second strap 220 is fixedly mounted to the housing 110, the second strap 220 may bend toward a side where the third side surface 221*a* is located, so as to better form an enclosed space, thereby wearing the electronic apparatus 100 to the body. And this kind of structure may avoid a reduction of a fatigue life of the second strap body 221 due to a too large bending of the second strap body 221 during the wearing process. Further, referring to FIG. 16, an end of the second connection portion 223 away from the second strap body 221 may be provided with a second planar surface 223*a*. The second planar surface 223*a* may be obliquely arranged relative to the length extension direction of the second connection portion 223. A second groove 223*b* may be defined between the second strap body 221 and the second planar surface 223*a*. The second groove 223*b* may be configured to mate with the electronic apparatus 100, thereby fixing the second strap 220 to the electronic apparatus 100. In some embodiments, during the process of inserting the second planar surface 223*a* of the second connection portion 223 into the housing 110 of the electronic apparatus 100, the second planar surface 223*a* could drive the locking structure in the housing 110 to move, such that the locking structure could enter into the second groove 223*b*, and then be confined in the housing 110 by an end of the second connection portion 223.

Technical features of the above-mentioned embodiments could be combined arbitrarily. In order to make the description concise, not all possible combinations of the various technical features in the above-mentioned embodiments are described. However, as long as there is no contradiction in the combination of these technical features, all combinations should be considered to be within the scope of the specification.

The above mentioned embodiments only express a few implementations of the present disclosure, the description thereof is relatively specific and detailed, but they could not be construed as a limitation on the scope of the patent application. It should be pointed out that, for those of ordinary skills in the art, without departing from the concept of this application, several modifications and improvements could be made, and these all fall within the protection scope of the present disclosure. Therefore, the protection scope of this patent application should be subject to the appended claims.

What is claimed is:

1. A band, configured to wear an electronic apparatus to a body of a user, comprising:

a first strap, comprising a first strap body, a first connection portion and a first mating portion, wherein the first connection portion is arranged on an end of the first strap body, the first mating portion is arranged on another end of the first strap body, the first strap body defines a connection hole between the first connection portion and the first mating portion, and the first connection portion is configured to connect with the electronic apparatus; and a second strap, comprising a second strap body, a second connection portion, a second mating portion and a buckle, wherein the second connection portion is arranged on an end of the second strap body, the buckle is arranged on another end of the second strap body, the second mating portion is arranged between the second connection portion and the buckle, the second connection portion is configured to connect with the electronic apparatus, the buckle is configured to be inserted into the connection hole to connect the first strap body and the second strap body, and the second mating portion is configured to be attracted to and coupled with the first mating portion, wherein the second strap body comprises a third side surface and a fourth side surface opposite to each other, the buckle protrudes from the fourth side surface, wherein one of the first mating portion and the second mating portion comprises a magnet, the other one of the first mating portion and the second mating portion comprises a magnet or a magnetic metal piece, wherein the first strap body comprises a first side surface and a second side surface opposite to each other, the connection hole penetrates the first side surface and the second side surface, when the electronic apparatus is worn to the body of the user, the first side surface fits the body of the user; when the electronic apparatus is worn to the body of the user, the third side surface fits the body of the user, the fourth side surface is configured to abut against the first mating portion, and wherein the third side surface defines a second recess region, the second mating portion is arranged in the second recess region.

* * * * *